US010327986B2

(12) United States Patent
Gross et al.

(10) Patent No.: US 10,327,986 B2
(45) Date of Patent: Jun. 25, 2019

(54) PARENTERAL VIAL CAP

(71) Applicant: SIO2 MEDICAL PRODUCTS, INC., Auburn, AL (US)

(72) Inventors: Renato Gross, Auburn, AL (US); Zachary Dean Freeman, Auburn, AL (US)

(73) Assignee: SiO2 Medical Products, Inc., Auburn, AL (US)

( * ) Notice: Subject to any disclaimer, the term of this patent is extended or adjusted under 35 U.S.C. 154(b) by 749 days.

(21) Appl. No.: 14/902,604

(22) PCT Filed: Jun. 24, 2014

(86) PCT No.: PCT/US2014/043810

§ 371 (c)(1),
(2) Date: Jan. 4, 2016

(87) PCT Pub. No.: WO2015/002768

PCT Pub. Date: Jan. 8, 2015

(65) Prior Publication Data

US 2016/0184182 A1 Jun. 30, 2016

Related U.S. Application Data

(60) Provisional application No. 61/842,478, filed on Jul. 3, 2013, provisional application No. 61/862,204, filed on Aug. 5, 2013.

(51) Int. Cl.
*B65D 51/00* (2006.01)
*A61J 1/14* (2006.01)
(Continued)

(52) U.S. Cl.
CPC ..... *A61J 1/1425* (2015.05); *B65D 39/0005* (2013.01); *B65D 43/16* (2013.01);
(Continued)

(58) Field of Classification Search
CPC ... A61J 1/1425; B65D 51/18; B65D 39/0005; B65D 43/16; B65D 51/1688;
(Continued)

(56) References Cited

U.S. PATENT DOCUMENTS 4,205,754 A * 6/1980 Nielsen ..... B65D 51/002 215/249
4,244,478 A * 1/1981 Handman ..... B65D 51/002 215/249
(Continued)

FOREIGN PATENT DOCUMENTS

DE 29710136 U1 9/1997
EP 0528120 A1 2/1993
(Continued)

OTHER PUBLICATIONS

International Search Report for PCT/US2014/043810, dated Sep. 30, 2014.

*Primary Examiner* — Ernesto A Grano
(74) *Attorney, Agent, or Firm* — David B. Gornish

(57) ABSTRACT

A parenteral vial, stopper and cap assembly comprises a vial having a body defining an interior, and an opening leading to the interior. The assembly further comprises a stopper configured to sealingly engage the opening, a cap configured to cover the opening and the stopper. The stopper and the cap fit together to form an integral unit configured to cap the vial. The cap moves with respect to the vial between a partially engaged position that permits gas flow out from the vial interior, and a fully engaged position in which the stopper sealingly engages the opening.

42 Claims, 12 Drawing Sheets

(51) Int. Cl.

| | |
|---|---|
| ***B65D 51/16*** | (2006.01) |
| ***B65D 51/20*** | (2006.01) |
| ***B65D 39/00*** | (2006.01) |
| ***B65D 43/16*** | (2006.01) |
| ***B65D 51/18*** | (2006.01) |

(52) U.S. Cl.
CPC ..... *B65D 51/1688* (2013.01); *B65D 51/18* (2013.01); *B65D 51/20* (2013.01); *B65D 2251/009* (2013.01); *B65D 2251/0012* (2013.01); *B65D 2251/0028* (2013.01); *B65D 2251/0084* (2013.01)

(58) Field of Classification Search
CPC ..... B65D 51/20; B65D 2251/009; B65D 2251/0012; B65D 2251/0028; B65D 2251/0084
USPC ..... 215/43
See application file for complete search history.

(56) References Cited

U.S. PATENT DOCUMENTS

| | | | | |
|---|---|---|---|---|
| 5,012,928 | A * | 5/1991 | Proffitt | B65D 21/0233 206/508 |
| 5,320,603 | A | 6/1994 | Vetter et al. | |
| 5,344,036 | A * | 9/1994 | Stanescu | B65D 23/001 215/249 |
| 5,678,718 | A * | 10/1997 | Morris | B65D 45/322 215/213 |
| 5,718,348 | A | 2/1998 | Manera | |
| 5,901,866 | A * | 5/1999 | Storar | B65D 41/28 215/249 |
| 7,100,646 | B2 * | 9/2006 | Py | A61J 1/1406 141/329 |
| 8,002,130 | B2 * | 8/2011 | Thilly | B65D 51/002 215/249 |
| 8,978,909 | B2 * | 3/2015 | Kakutani | B65D 51/002 141/329 |
| 9,260,227 | B2 * | 2/2016 | Kawamura | B65D 51/002 |
| 9,382,044 | B2 * | 7/2016 | Chanas | B65D 41/48 |
| 9,540,154 | B2 * | 1/2017 | Vrijens | A61J 1/1406 |
| 9,555,941 | B2 * | 1/2017 | Ogawa | A61J 1/05 |
| 9,731,877 | B2 * | 8/2017 | Aneas | B65D 51/00 |
| 9,815,601 | B2 * | 11/2017 | Browne | B65D 51/002 |
| 2002/0074387 | A1 * | 6/2002 | Stewart | B65D 5/703 229/125.09 |
| 2005/0178462 | A1 * | 8/2005 | Py | A61J 1/18 141/2 |
| 2009/0001042 | A1 * | 1/2009 | Sever | B65D 41/28 215/248 |
| 2010/0050575 | A1 * | 3/2010 | Aneas | B65D 41/28 53/485 |
| 2010/0089862 | A1 | 4/2010 | Schmitt | |

FOREIGN PATENT DOCUMENTS

| | | | |
|---|---|---|---|
| EP | 0834457 | A1 | 4/1998 |
| EP | 2174884 | A1 | 4/2010 |
| WO | 2005000703 | A2 | 1/2005 |

* cited by examiner

PARENTERAL VIAL CAP

CROSS REFERENCE TO RELATED APPLICATION

This application claims the benefit of U.S. Provisional Patent Application Nos. 61/842,478, filed Jul. 3, 2013 and 61/862,204, filed Aug. 5, 2013 which are incorporated herein as if fully set forth.

FIELD OF INVENTION

The invention pertains to a cap for closing a parenteral vial. More specifically, the invention pertains to a cap for closing a parenteral vial in cooperation with a vial stopper, wherein the cap and stopper fit together as an integral unit that can be applied to the parenteral vial as a unit, which moves between a partially engaged position that allows for escape of vapor from the vial interior during lyophilization procedures, and a fully engaged position in which the stopper sealingly closes the vial.

BACKGROUND

Injectable parenteral drugs are typically packaged in parenteral vials. Packing of such parenteral drugs may include processing steps that are specific to such parenteral vials and the drugs packaged therein. Such injectable parenteral drugs may be provided to the consumer in liquid or freeze dried form. For freeze dried parenteral drugs, the vial containing the drug is closed with a lyophilization stopper, and undergoes a lyophilization step, prior to closing of the vial. The vials are then closed by standard stoppers, and a metal crimp is applied around the vial rim to retain the stopper therein. Vials containing liquid parenteral drugs are provided with a stopper that sealingly engages the vial at the filling point. Vial filling and packaging can take place via a filling line, with the vials housed in a vial tray such as that disclosed in U.S. Provisional Patent Application No. 61/767,496, which is incorporated herein by reference as if fully set forth. During application of the metal crimp, vials are typically lifted out from the tray, so that the crimp applying apparatus can adequately access the vial rim. Furthermore, in the case of freeze dried drugs, the additional step of lyophilization requires the ability of vaporized moisture removed from the parenteral drug to exit during processing. This step typically takes place outside of the tray. A need exists for a mechanism that functions similarly to the metal crimp used to close parenteral vials, while allowing escape of vapors during lyophilization. A further need exists for such a mechanism that can be applied without lifting the vial out of the processing tray, in order to simplify processing. A further need exist to standardize the stopper and cap, eliminating the need for specific caps for liquid and dried parenteral drugs. Such a mechanism would advantageously allow for simplified processing of liquid and dried parenteral drugs together.

SUMMARY

The present invention relates to a parenteral vial, stopper and cap assembly comprising a vial having a body defining an interior, and an opening leading to the interior. The assembly further comprises a stopper configured to sealingly engage the opening, and a cap configured to cover the opening and the stopper. The stopper and the cap fit together to form an integral unit configured to cap the vial. The cap moves with respect to the vial between a partially engaged position that permits gas flow out from the vial interior, and a fully engaged position in which the stopper sealingly engages the opening.

DETAILED DESCRIPTION OF THE PREFERRED EMBODIMENTS

Figure 1:
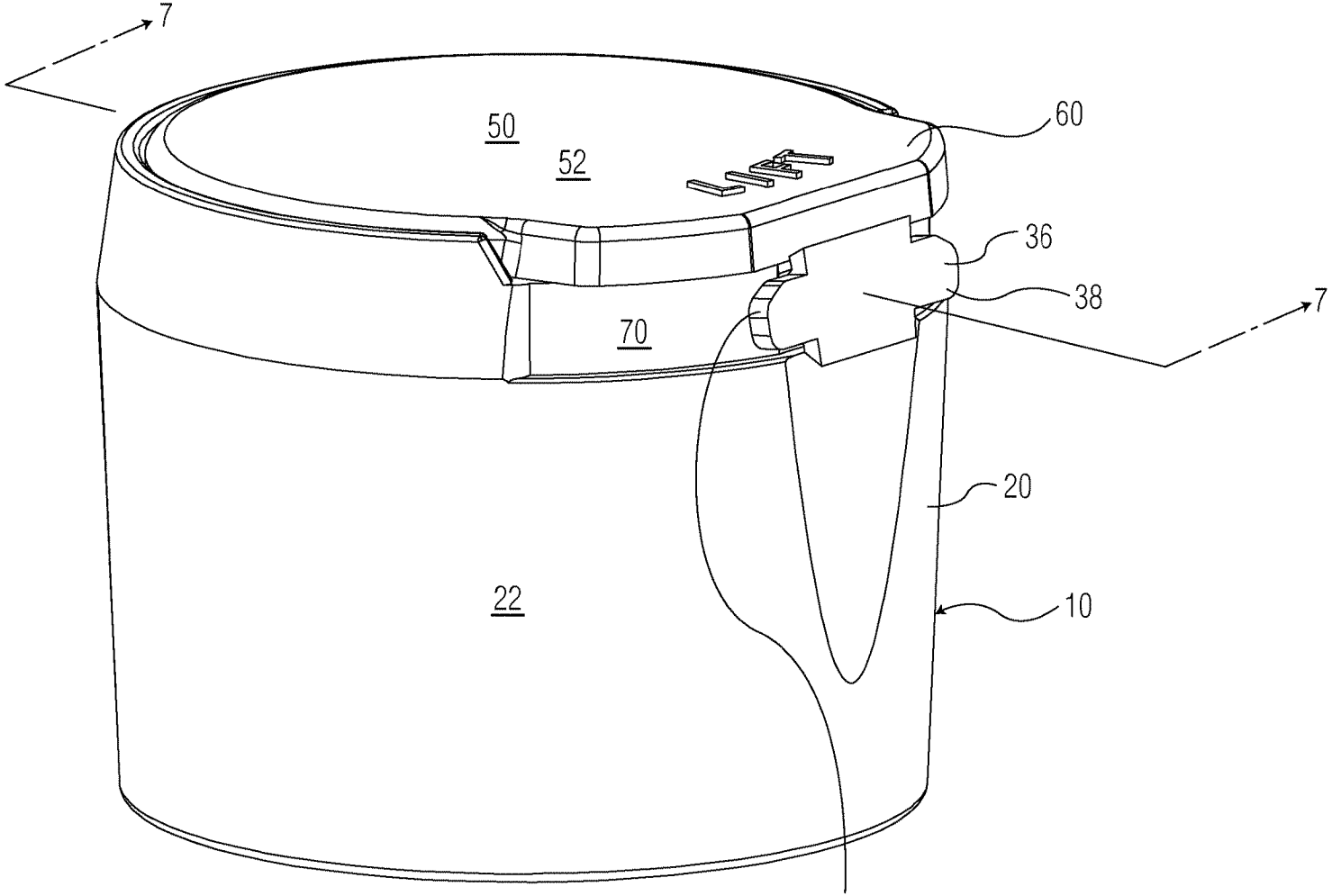
FIG. 1 is a perspective view of an embodiment of a cap according to the invention, in a closed position.

Certain terminology is used in the foregoing description for convenience and is not intended to be limiting. Words such as "front," "back," "top," and "bottom" designate directions in the drawings to which reference is made. This terminology includes the words specifically noted above, derivatives thereof, and words of similar import. Additionally, the words "a" and "one" are defined as including one or more of the referenced item unless specifically noted. The phrase "at least one of" followed by a list of two or more items, such as "A, B or C," means any individual one of A, B or C, as well as any combination thereof.

FIGS. 1-5 and 7-9 show an embodiment of a parenteral vial cap 10 according to the invention. As shown, the cap 10 includes a main body 20 and a cover 50. The main body 20 is formed as a generally tubular wall 22 configured to surround the neck 82 of a parenteral vial 80. The cover 50 fits on top of the main body 20 to cover the opening when the cap 10 is in the closed position, as shown in FIGS. 1-3 and 6-9. The cap 10 is configured to accommodate a stopper 100, which is configured to sealingly fit within and close an opening 84 formed at the top of the vial neck 82 and leading to the interior 86. The cap 10 and the stopper 100 fit together to form an integral unit, which can be used to cap the vial 80. The cap 10 is configured to move with respect to the vial 80 between a partially engaged position that permits gas flow out from the vial interior, and a fully engaged position in which the stopper 100 sealingly engages the opening 84.

Figure 10:
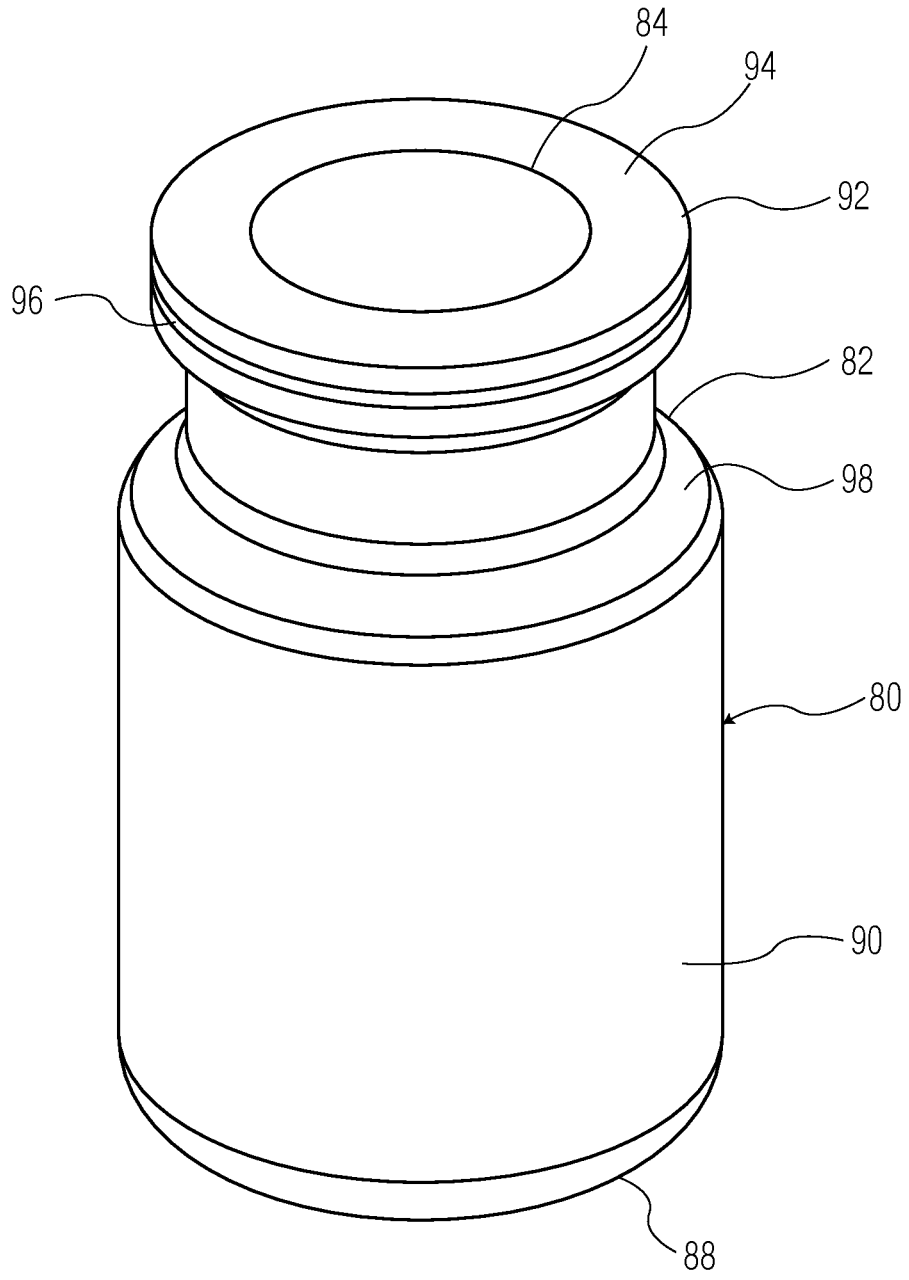
FIG. 10 is a perspective view of an exemplary vial for use with the cap of the invention.

Referring to FIG. 10, an exemplary vial 80 for use with the invention is shown. As shown, the vial 80 includes a base wall 88 and a substantially tubular side wall 90 extending upwardly from the base wall 88, the base wall 88 and side wall 90 together defining the interior 86 of the vial 80. A radially inwardly extending shoulder 98 is formed at an upper portion of the side wall 90 and joins the side wall 90 with the neck 82. A rim 92 is formed at an upper edge of the neck 82 as a section of increased radial thickness with respect to the neck 82. The rim 92 includes a top surface 94 and defines the opening 84 of the vial 80. An outer annular groove 96 is formed on an outer surface of the rim 90 and is configured to facilitate attachment of the cap 10, as described in detail below. An inner annular groove 97 is formed on an inner surface of the neck 82, near the opening 84, to facilitate attachment of the stopper 100, as described in detail below.

Figure 6:
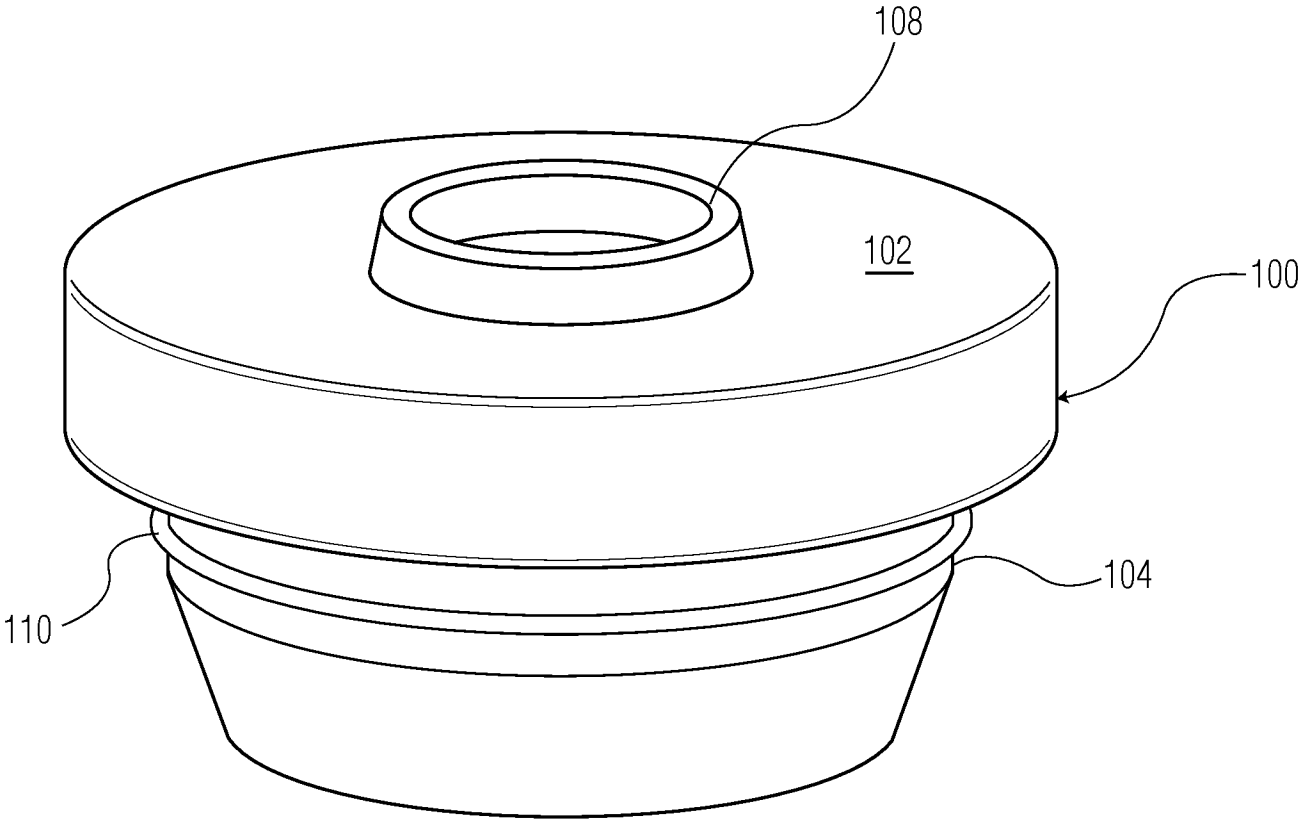
FIG. 6 is a perspective view of an exemplary stopper for use with the cap of the invention.
Figure 7:
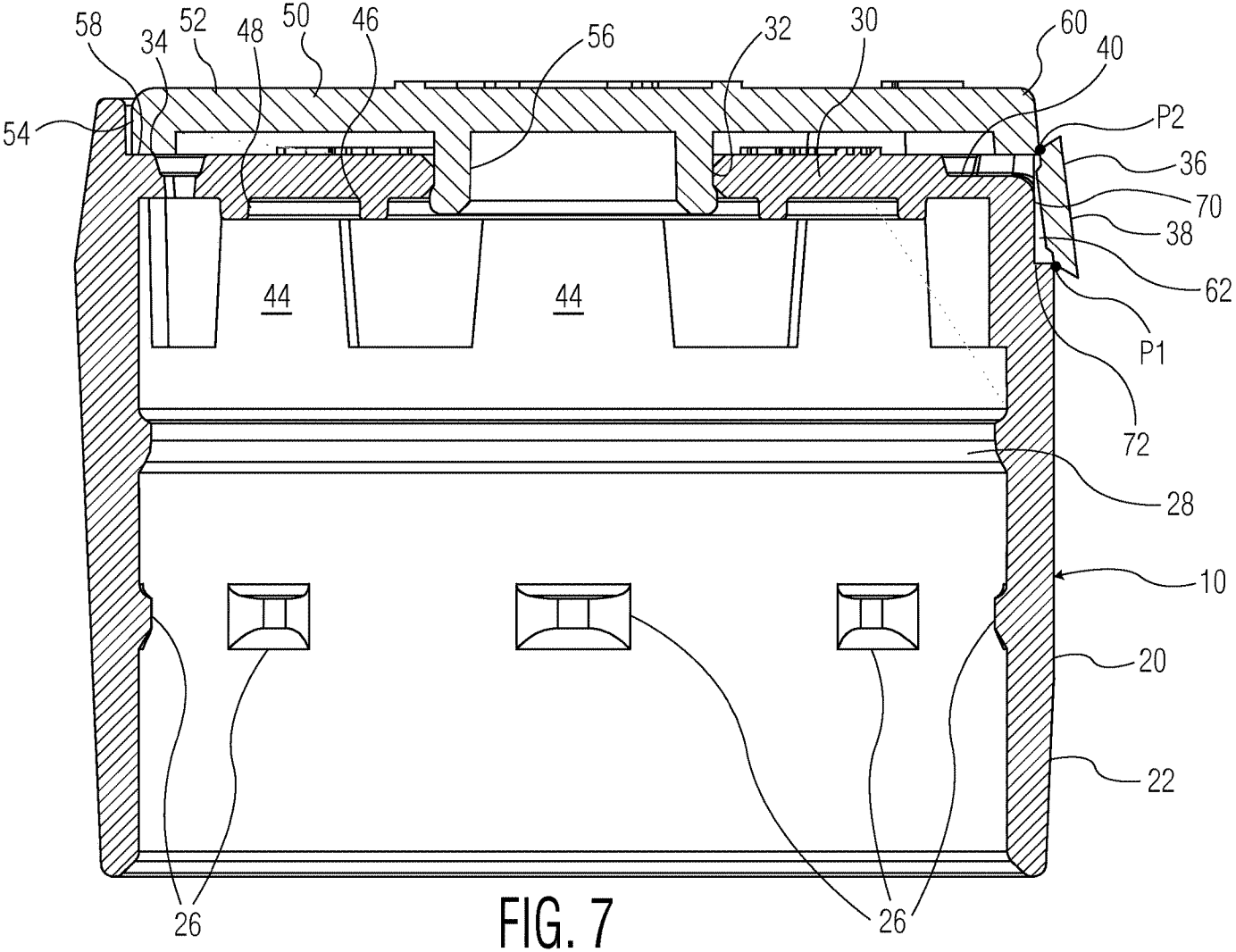
FIG. 7 is a cross section taken along line 7-7 of FIG. 1.
Figure 8:
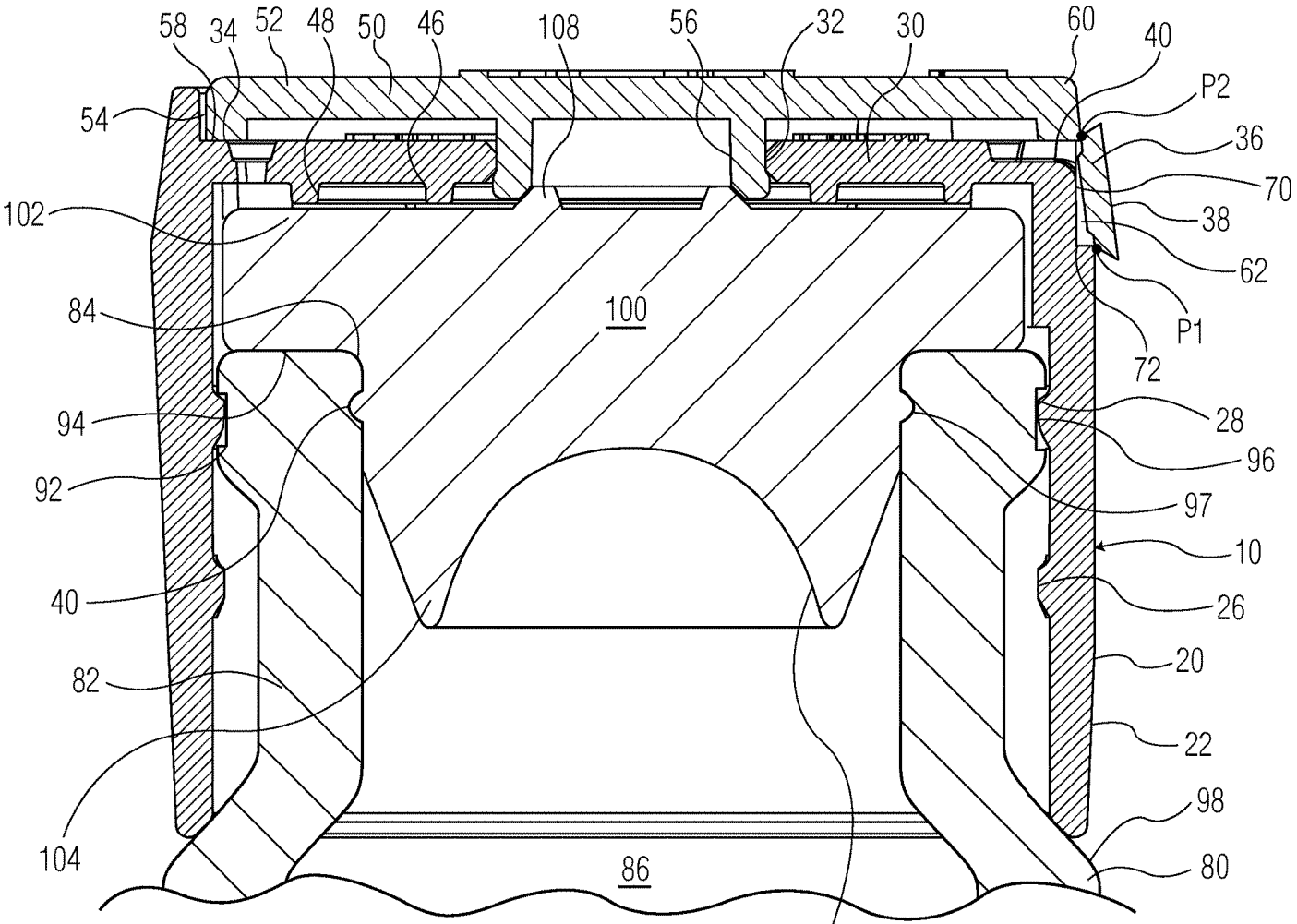
FIG. 8 is a partial cross section taken along line 8-8 of FIG. 3.
Figure 9:
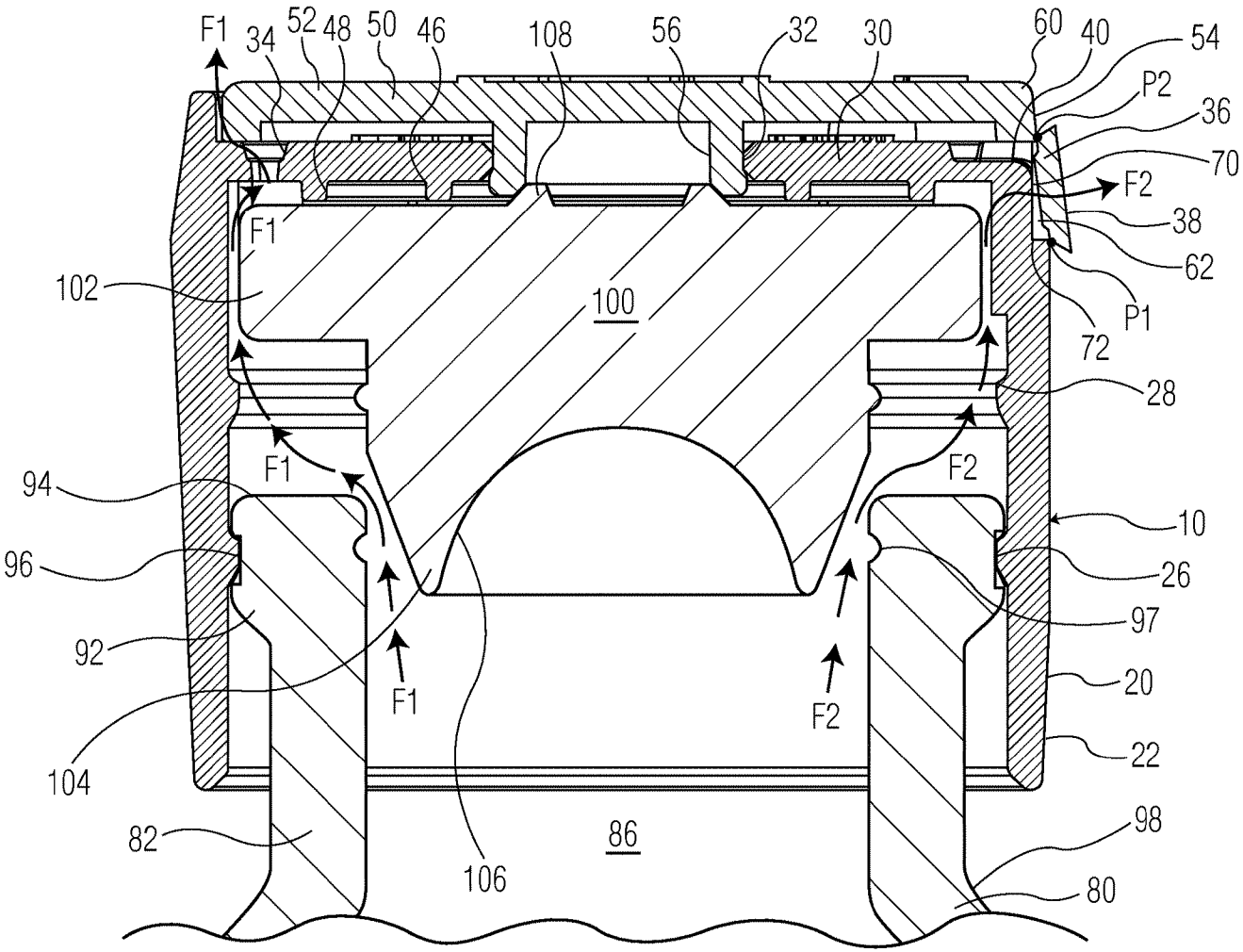
FIG. 9 is a cross section such as that of FIG. 8, with the cap in the lyophilization position.

Now referring to FIGS. 6, 8 and 9, an exemplary vial stopper 100 for use with the invention is shown in detail. As shown, the stopper 100 includes a substantially horizontally extending top wall 102 and a plug 104 extending downward therefrom. The top wall 102 is configured to completely or substantially completely cover the vial rim 92 and opening 84 when seated thereon. Accordingly, the top wall 102 has a diameter substantially equal to the outer diameter of the rim 92. The top wall 102 could alternatively have an outer diameter greater than that of the rim 92, or less than that of the rim 92, but greater than the inner diameter of the opening 84, such that the opening 84 is in any event covered by the top wall 102 when the stopper 100 is seated thereon. The outer edges of the top wall 102 and the rim 92 may be substantially radially aligned, such as in the illustrated embodiment in which the outer diameter of the rim 92 is slightly greater than that of the top wall.

The plug 104 extends downward from a bottom surface of the top wall 102 and has an outer diameter equal to or slightly greater than the inner diameter of the opening 84. In use, the plug 104 extends into the opening 84 and forms an interference fit therewith to seal the vial 80. The plug 104 may include a dome shaped indentation 106 at the bottom thereof, to facilitate deformation of the plug 104 during insertion into the opening 84 in order to achieve an optimum fit and seal. A first circular ridge 108 is formed on the top surface of the top wall 102, for engagement of the stopper 100 with the cap 10, as described in detail below. A second circular ridge 110 is formed on an outer surface of the plug 104 to facilitate engagement with the vial opening 84, as described in detail below.

With reference to FIGS. 1-5, and 7-9, the cap 10 will now be described in detail. The cap 10 comprises a main body 20 and a cover 50. The main body 20 is formed as a substantially tubular wall 22. The tubular wall 22 is configured to surround the vial rim 92 and stopper top wall 102 when the cap 10 is affixed on the vial 10. As shown, the inner diameter of the tubular wall 22 is slightly greater than the outer diameters of the rim 92 and top wall 102. The tubular wall 22 has a sufficient length in the axial direction to permit extension from the shoulder 98 to a point above the top wall 102 of the stopper 100, when the cap 10 is in the fully closed position on the vial 80, as shown in FIG. 8. A plurality of radially inwardly extending protrusions 26 are formed on the inner surface of the tubular wall 22. A radially inwardly extending annular ridge is 28 further formed on the inner surface of the tubular wall 22, at an axial location above the protrusions 26.

Figure 2:
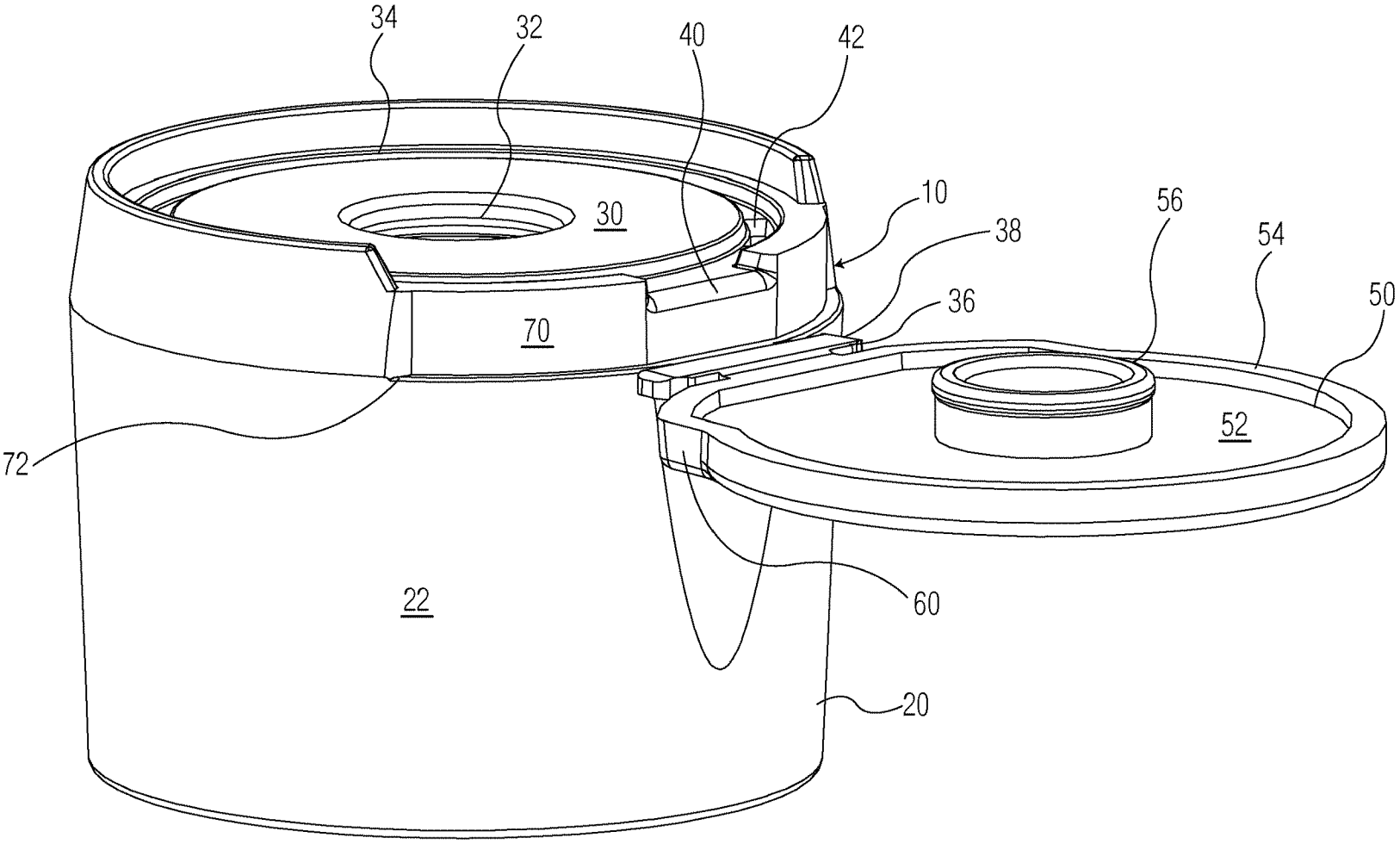
FIG. 2 is a perspective view of the cap of FIG. 1, in an opened position.
Figure 3:
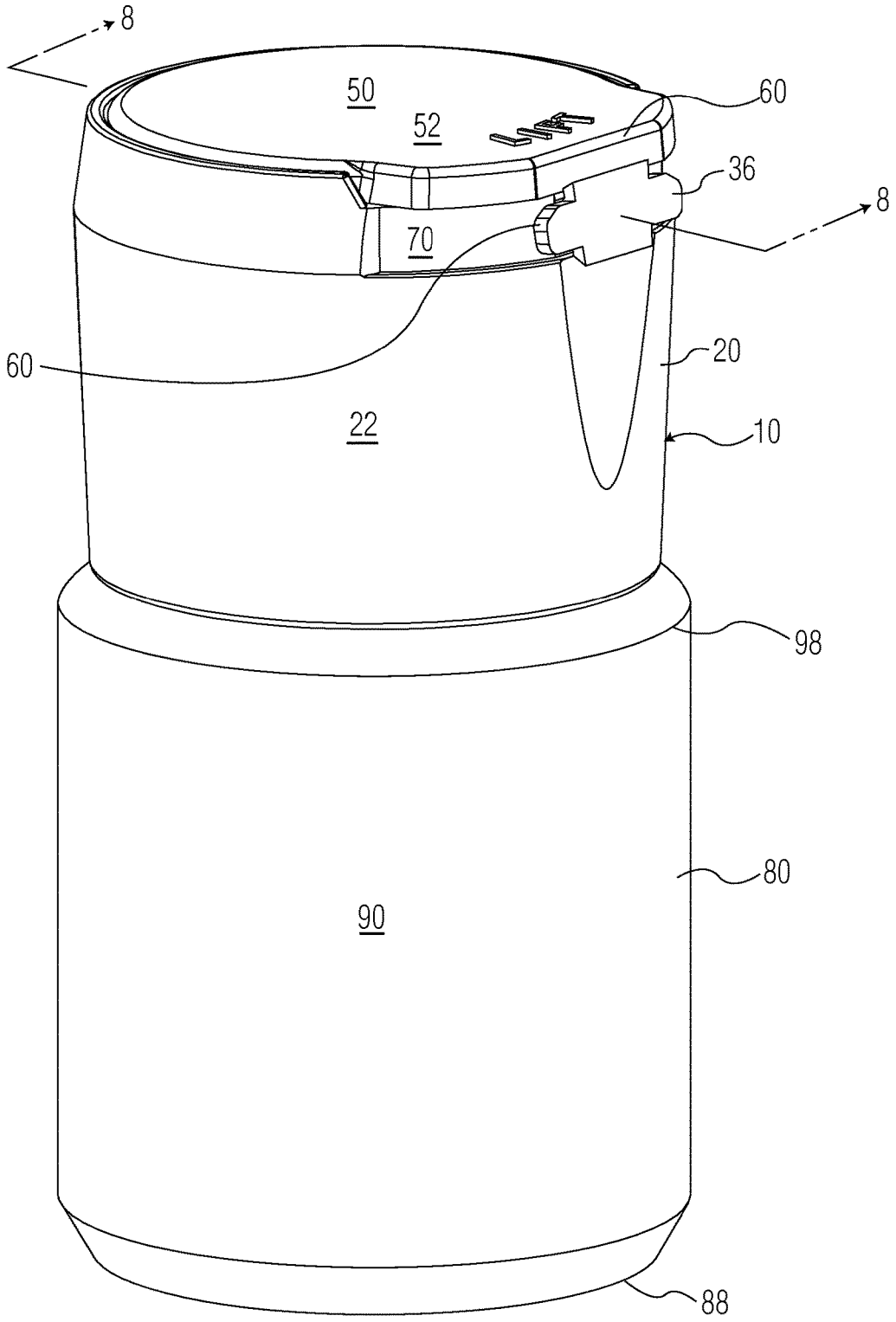
FIG. 3 is a perspective view of the cap as shown in FIG. 1, affixed to a parenteral vial, in the fully engaged, closed position.
Figure 4:
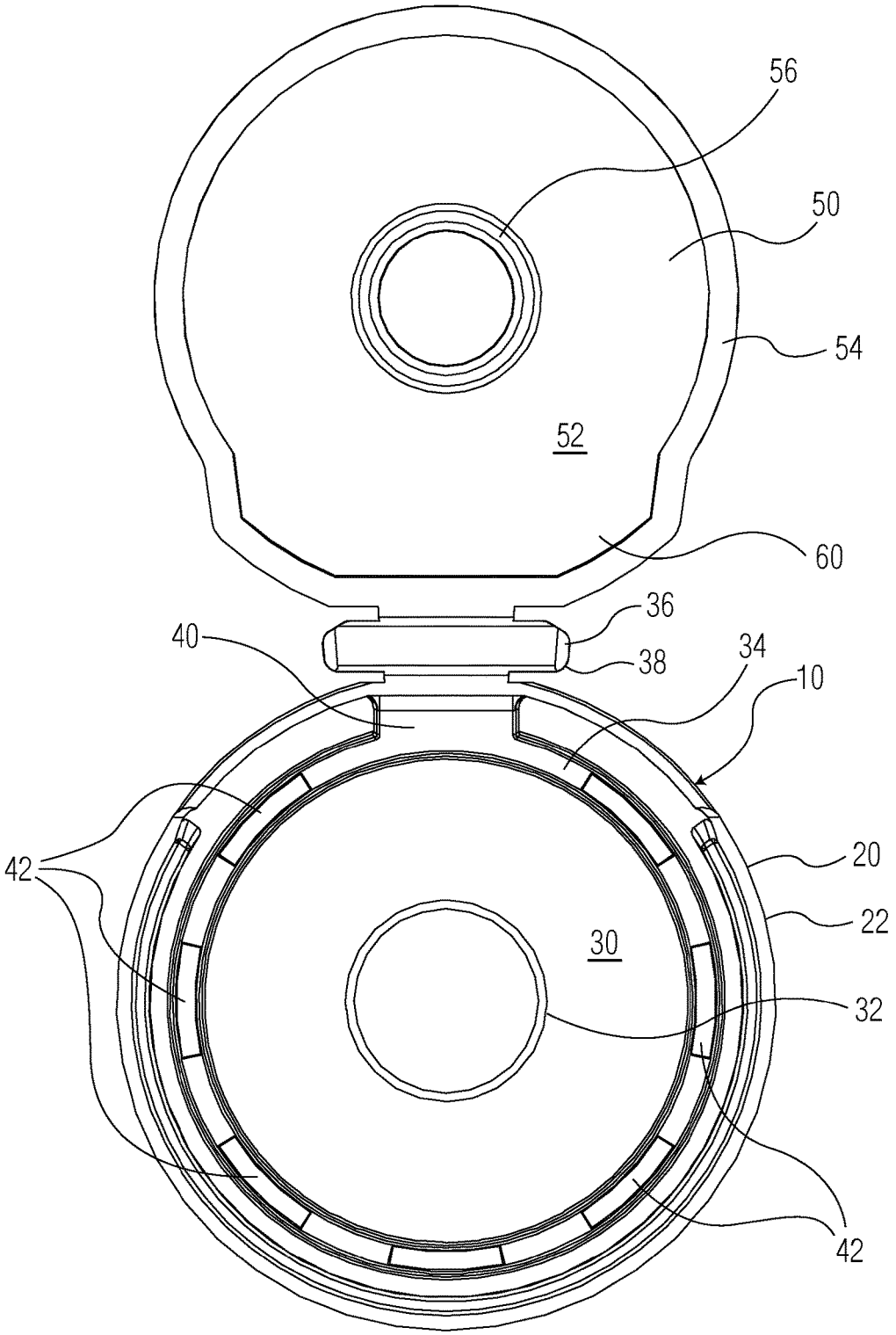
FIG. 4 is a top plan view of the cap of FIG. 1, in an opened position.
Figure 5:
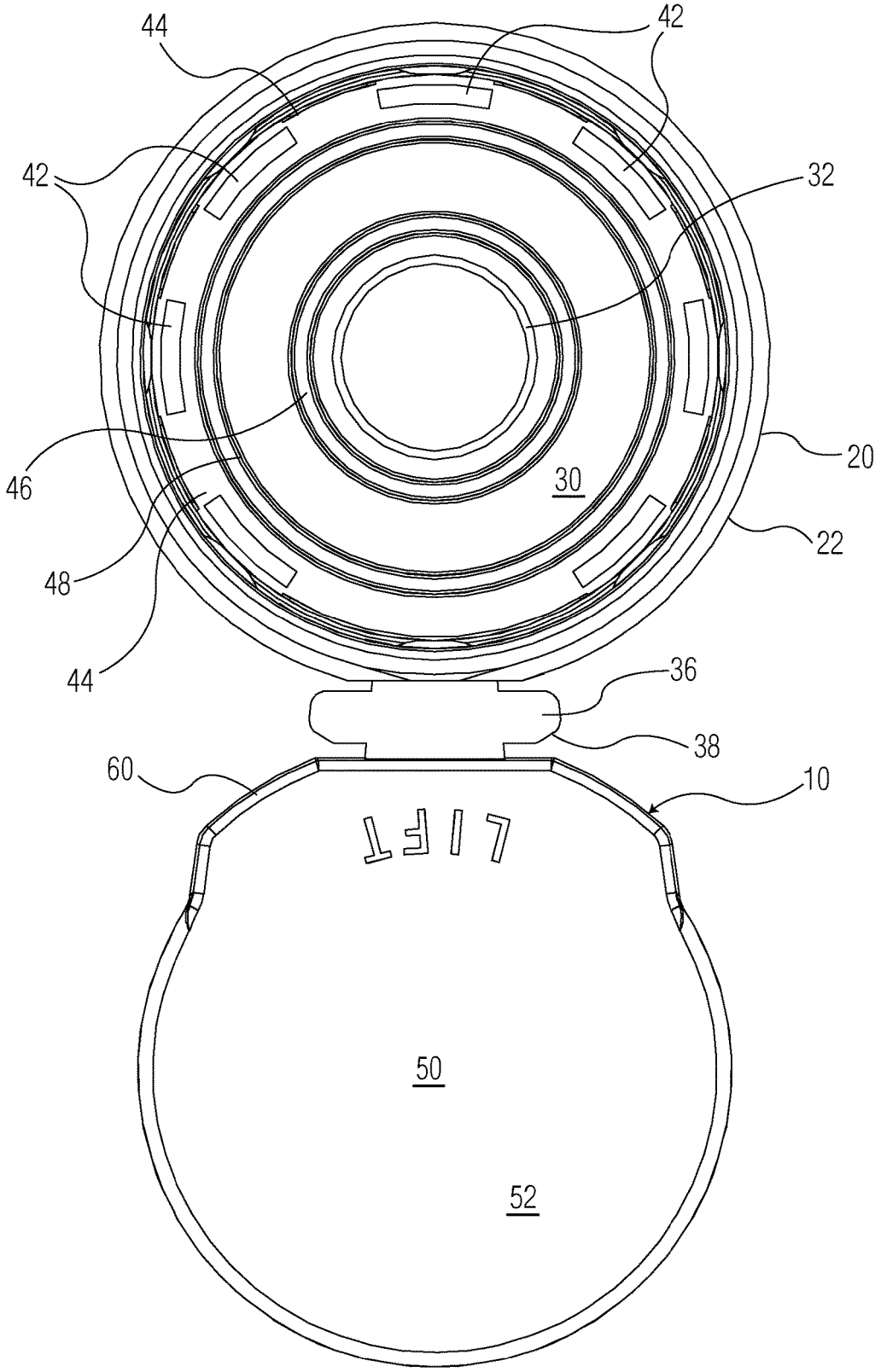
FIG. 5 is a bottom plan view of the cap of FIG. 1, in an opened position.

Referring now to FIGS. 2, 4 and 5, a top wall 30 extends across an upper portion of the tubular wall 22. The top wall 30 extends in the horizontal or radial direction of the cap 10, near the top edge of the tubular wall 22. A central, circular aperture 32 is formed in the top wall. Additionally, a channel 34 extends circumferentially near the edge of the top wall 30, about the entire circumference thereof. A valley 40, formed as an extension of the channel 34, extends radially outward therefrom, from an outer edge of the channel 34 to an outer edge of the top wall 30 radially aligned with and adjacent to the hinge 36. The valley 40 terminates where the top wall 30 meets the tubular wall 22 at a radially inwardly indented region 70 thereof. The indented region 70 is located on an outer surface of the tubular wall 22, radially aligned with the hinge 36, and joins with an axially upper edge of the tubular wall 22. A gap 62 is formed between an inner surface of the hinge tab 38 and the indented region 70 of the tubular wall 22.

Figure 11:
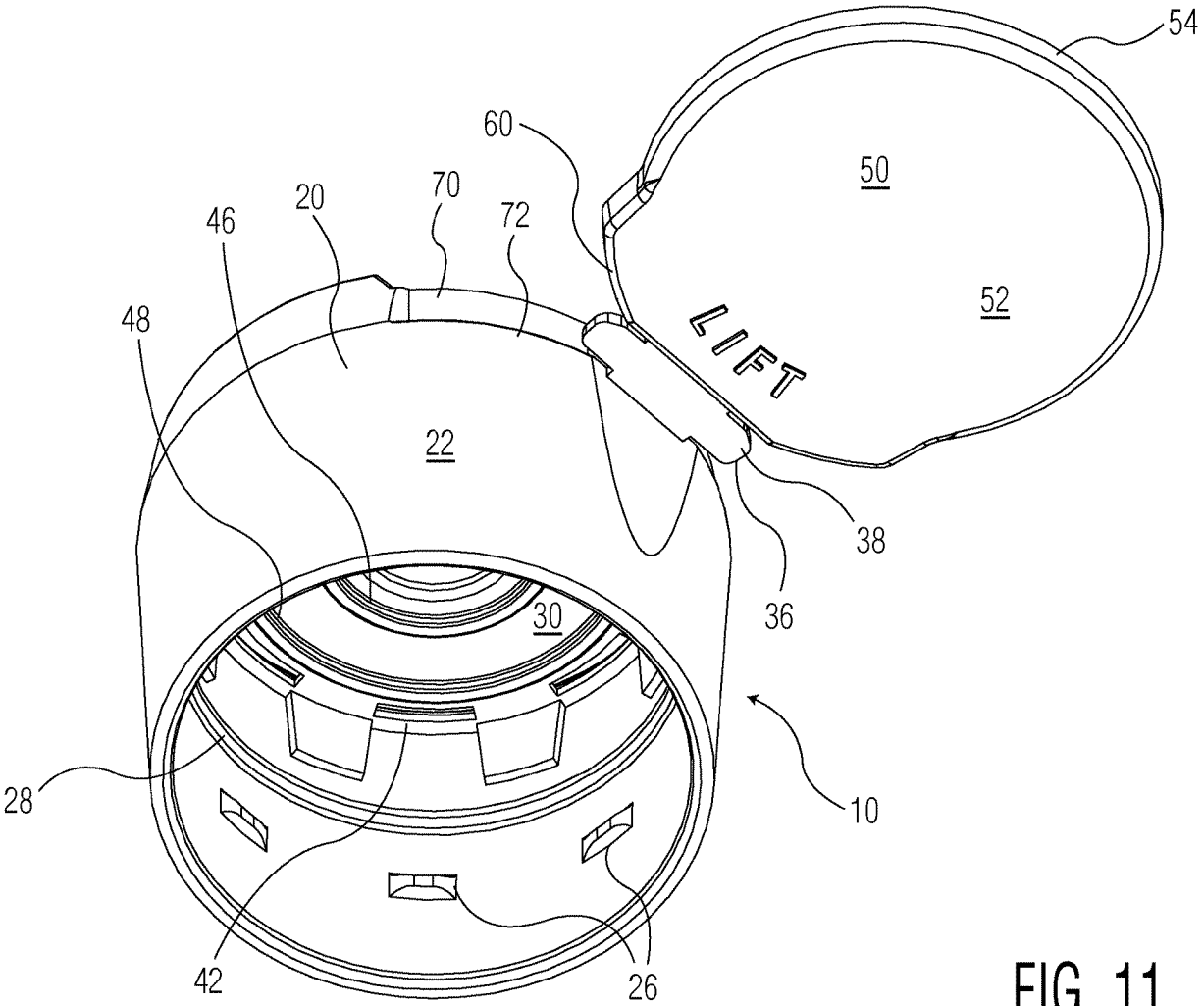
FIG. 11 is a bottom perspective view of the vial cap of FIG. 1, in an opened position.

A plurality of openings 42 are formed in the top wall 30 within the channel 34. Depressions 44 in the thickness of the tubular wall 22 are formed on the inner surface thereof, in axial alignment with the openings, as shown in FIG. 11. One or more annular projections 46, 48 may be formed in the bottom surface of the top wall 30, radially located between the aperture 32 and the channel 34. In the illustrated embodiment, two projections are formed, including a radially inner projection 46 and a radially outer projection 48, though fewer or more projections could be formed as well. The projections 46, 48 are configured to contact and exert an even force on the stopper 100 when moving the cap 10 from the partially engaged position to the fully engaged position, as described below.

The hinge 36 is formed as a tab 38 that pivotally attaches an edge of the cover 50 to an upper portion of the tubular wall 22. The hinge 36 is a double hinge, such that it includes a first pivot axis P1 where it attaches to the tubular wall 22 and a second pivot axis P2 where it attaches to cover 50. The hinge 36 is preferably of the "living hinge" type, i.e., formed integrally with the remainder of the cap 10, with the pivot axes P1, P2 being formed as sections of material sufficiently thin to as to permit bending. The hinge 36 permits the cover 50 to rotate with respect to the main body 20 between an opened position, for example as shown in FIG. 2, and a closed position, for example as shown in FIG. 1.

The cover includes a cover base 52, which is formed as a round wall configured to cover the top wall 30 of the main body 20 when in the closed position. An outer flange 54 extends downward from a bottom surface of the base 52 and around the entire outer perimeter of the base 52, and is configured to be received by the channel 34, when the cover 50 is in the closed position. Outer flange 54 does not sit perfectly within channel 34; rather, a small gap 58 is formed therebetween. An inner ring 56 also projects downward from the bottom surface of the base 52, at a substantially central location thereof, and is configured to fit within the aperture 32 when the cover is in the closed position.

Figure 12:
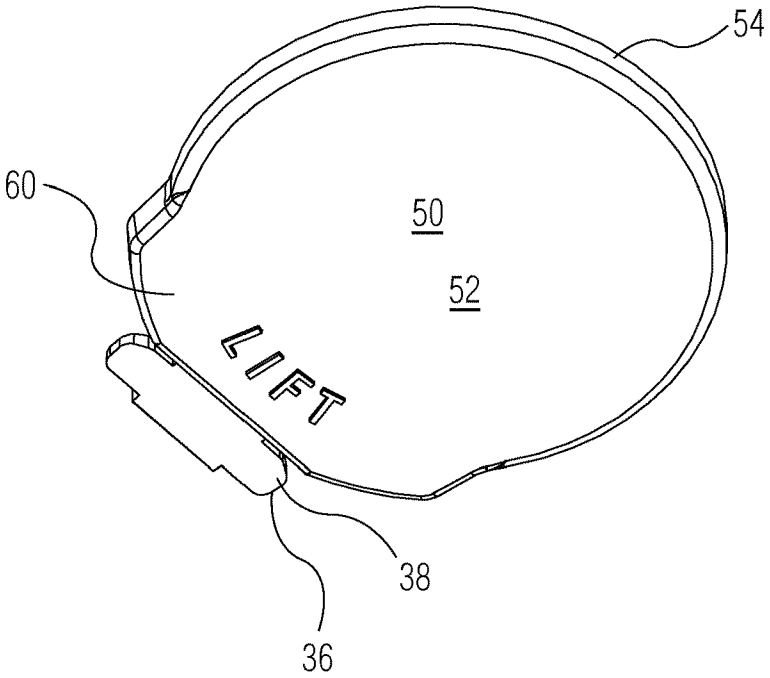
FIG. 12 is a bottom perspective view of the vial cap of FIG. 1, in an opened position, with the hinge broken.
Figure 12:
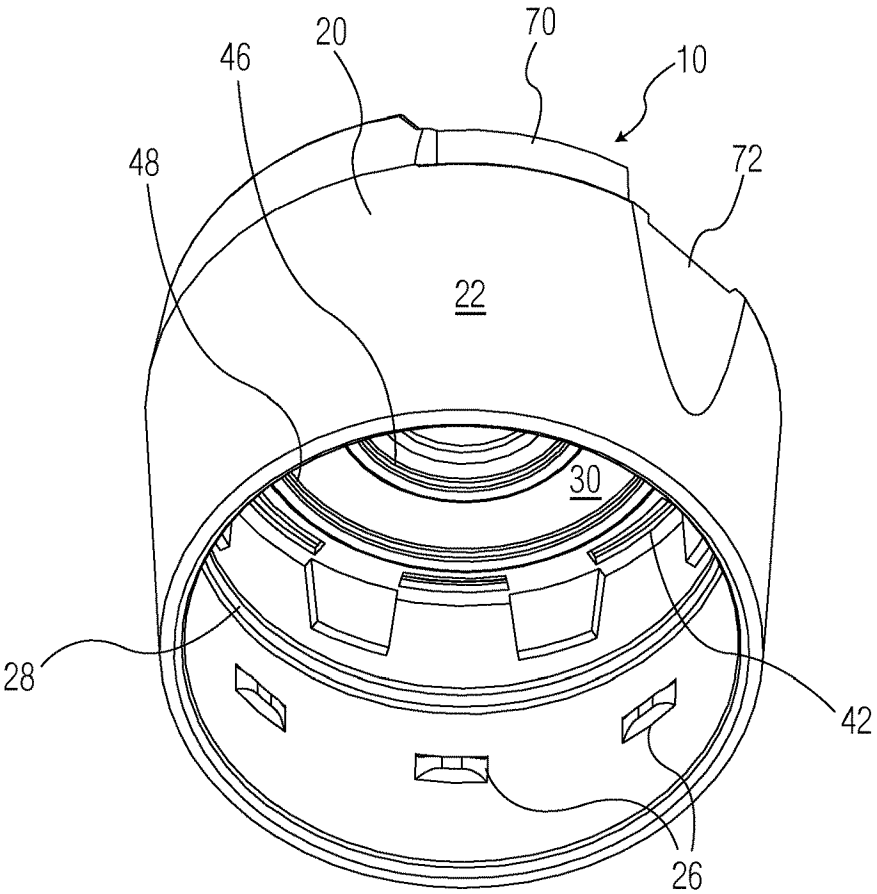

The cap 10, when affixed to the vial 80, moves between a partially engaged, or lyophilization position, as shown in FIG. 9, and a fully engaged position, as shown in FIG. 8. The cap 10 in the fully engaged position is located axially below the partially engaged position. Furthermore, the cover 50 moves between an initial opened position, as shown in FIG. 2, a closed position, as shown in FIG. 1, and a final opened position, as shown in FIG. 12, in which the hinge 36 has been broken.

Referring first to FIG. 9, the partially engaged position will be described in detail. As shown, when the cap 10 is in the partially engaged position, the cover 50 is in the closed position. Accordingly, the cover 50 sits atop the main body 20 with outer edge of the base 52 resting on the upper edges of the tubular wall 22. The stopper 100 is positioned within the tubular wall 22 and beneath the top wall 30. The aperture 32 and openings 42 are covered by the cover 50. Flange 54 sits within channel 34. Preferably, flange 54 and channel 34 are frictionally engaged, and may form an interference fit. Engagement of the flange 54 and channel 34 helps to retain the cover 50 in place on the tubular wall 22.

Still referring to FIG. 9, ring 56 projects downward from the bottom surface of cover base 52 and fits within aperture 32 of top wall. Preferably, ring 56 and aperture 32 are frictionally engaged, and may form an interference fit. Engagement of the ring 56 and aperture 32 helps retain the cover 50 on the main body 20, keeping the cover 50 in the closed position.

Ring 56 continues to project downward past aperture 32, and reaches the top wall 102 of stopper 100, where it receives the first ridge 108. Preferably, the first ridge 108 and ring 56 are frictionally engaged, and may form an interference fit. Engagement of the first ridge 108 and ring 56 helps retain the stopper 100 in place beneath the top wall 30 of the cap main body 20.

Still referring to FIG. 9, protrusions 26 of the tubular wall 22 are received within the outer annular groove 96 of vial rim 92. Preferably, protrusions 26 and outer annular groove 96 are frictionally engaged, and may form an interference fit. Engagement of the protrusions 26 and outer annular groove 96 help retain the cap 10 in place on the vial 80 in the partially engaged, or lyophilization position. Preferably, the engagement of the protrusions 26 and the ridge 28 is strong enough so as to prevent inadvertent disengagement, for example as could be caused by bumping the cap 10, but not so strong as to prevent disengagement to move the cap 10 downward on the vial 80, into the fully engaged position, as described below.

When the cap 10 is in the partially engaged position on the vial 10, the opening 84 of the vial 10 is substantially covered, to prevent foreign objects from entering. Additionally, the stopper 100, while not yet directly engaged with the vial 10, is positioned to be moved directly downward to be positioned on the vial 10. This position permits gas flow out from the vial interior 86. As shown in FIG. 9, a plurality of flow paths F are formed from the interior 86 to the exterior of the vial 10, to allow for escape of moisture vapor during lyophilization. As shown in FIG. 9, several of the flow paths F1 begin at the vial interior 86 and travel between the vial rim 92 and stopper plug 104, outward then upward between the tubular wall 22 and outer edge of stopper top wall 102 within depressions 44, inward between the stopper top wall 102 and cap base top wall 30, upwards through openings 42, then outwards through gap 58 formed between flange 54 and channel 34. Additional flow paths F2 begin at the vial interior 86 and travel between the vial rim 92 and stopper plug 104, outward then upward between the tubular wall 22 and cap base top wall 102 within depressions 44, inward between the stopper top wall 102 and cap base top wall 30, upwards through openings 42, through channel 34 and then through valley 40 and outward through gap 62.

After lyophilization, the cap 10 is moved downwards on the vial, to the fully engaged position, as shown in FIG. 8. In this position, the stopper 100 and the cap 10 remain in the same position with respect to each other and retain their engagements with each other. Accordingly, the above-described engagements between the ring 56 and aperture 32 as well as the ring 56 and ridge 108, remain in place. The cap 10 and stopper 100 together move downward as a unit with respect to the vial 80 to move the assembly into the fully engaged position.

As shown, in the fully engaged position, the ridge 28 of tubular wall 22 is now received by outer annular groove 96 of vial rim. Preferably, the ridge 28 and outer annular groove 96 are frictionally engaged, and may form an interference fit. Engagement of the ridge 28 and outer annular groove 96 helps retain the cap 10 in place on the vial 80 in the fully engaged position. Preferably, the engagement of the ridge 28 and groove 96 is sufficient to prevent disengagement that would allow movement of the cap 10 with respect to the vial 80, for example removal of the cap 10 from the vial 80 using manual force. It is for this reason that a complete annular ridge 28 is provided on the inner surface of the tubular wall for this purpose, in contrast to the protrusions 26 provided for engagement with the outer annular groove 96 when in the partially engaged position, which results in a weaker engagement, so as to permit moving the cap 10 from the partially engaged position to the fully engaged position.

Also in the fully engaged position, the plug 104 is received within the vial opening 84. Preferably, the plug 104 and the opening 84 are frictionally engaged and may form an interference fit. The second ridge 110 formed on the outer surface of the stopper plug 104 is received by the inner annular groove 97. Preferably, the second ridge 110 and the inner annular groove 97 are frictionally engaged, and may form an interference fit. Engagement between the second ridge 110 and inner annular groove 97 helps retain the plug 104 within the opening 84 and in turn cap 10 in place on the vial 80 in the fully engaged position.

In the fully engaged position, flow path F has been closed off by closing the spaces between the stopper 100 and vial rim 92. The stopper 100 and vial rim 92 preferably form a sealed engagement, to prevent entry of foreign objects, as well as to prevent entry and further exit of any liquid or gas matter. The assembly, including cap 10, vial 80, and stopper 100 is suitable for transport and distribution to consumers at this point.

The hinge 36 may serve as a tamper evident feature of the cap 10. When the vial 80 and cap 10 assembly reaches a consumer, the cover 50 is to be removed from the cap 10, giving the user access to the aperture 32 and the stopper top wall 102 located below. A tab 60 is formed as an extension of the cover base 52. The tab 60 protrudes slightly outward from the cover base 52, and may be located over the indented region 70 on the outer surface of tubular wall 22, such that a user can easily access tab 60 as a source of leverage to permit removal of the cover 50 from cap base 50. Hinge 36 connects tab 50 with a step 72 formed at the bottom of indented region 70. In order to force the cover 50 off of main body 20 by way of tab, hinge 36 must be broken, which can be achieved easily at the fold formed by first pivot axis P1. The hinge 36 may optionally include a perforation 40 at the first pivot point P1, to facilitate breaking of the hinge in this manner. A broken hinge 36 alerts the consumer that the cover 50 has been detached from main body 20, serving as a tamper evident mechanism. FIG. 12 shows the cap in the final opened position, with the hinge 36 broken at the first pivot axis P1 to alert the consumer that the cover 50 has been detached from the main body 20.

Once the cover 50 is removed from main body 20 and top wall 102 of stopper is accessible, the consumer can insert a syringe through top wall 102 and retrieve a dose of the medication contained within the vial 80.

The components of the assembly described above can each be made of any suitable material known in the art. Exemplary materials for forming the vial include glass and polymeric materials, such as cyclic olefin polymer and cyclic olefin copolymer. Exemplary materials for forming the cap include polymeric materials such as polypropylene. Exemplary materials for forming the stopper include elastomeric materials.

While the preferred embodiments of the invention have been described in detail above, the invention is not limited to the specific embodiments described, which should be considered as merely exemplary.

What is claimed is:

1. A parenteral vial, stopper and cap assembly, comprising:

a vial having a body defining an interior, and an opening leading to the interior;

a stopper configured to sealingly engage the opening; and a cap configured to cover the opening of the vial and the stopper, the cap including a main body formed as a tubular wall and a cover configured to fit over the tubular wall, a hinge pivotally attaches the cover to the main body, the hinge being a double hinge that includes a first pivot axis and a second pivot axis;

wherein the stopper and the cap fit together to form an integral unit;

wherein the cap moves with respect to the vial between a partially engaged position that permits gas flow out from the vial interior, and a fully engaged position in which the stopper sealingly engages the opening; and wherein the hinge is configured to be broken to serve as a tamper evident feature.

2. The assembly of claim 1, wherein the vial comprises a neck and a rim at an upper edge of the neck, the rim defining the opening, wherein the cap is configured to cover the rim when in the partially engaged position and the engaged position.

3. The assembly of claim 1, wherein the vial comprises a neck and a rim at an upper edge of the neck, and the tubular wall surrounds the neck and the rim when the cap is in the partially engaged position and the fully engaged position.

4. The assembly of claim 3, wherein the cap accommodates and retains the stopper, wherein the stopper comprises a top wall and a plug extending downward from a bottom surface of the top wall, and the top wall sits beneath the cover when the stopper is retained by the cap.

5. The assembly of claim 3, wherein:

the tubular wall comprises a plurality of radially inwardly extending protrusions on an inner surface thereof;

the rim comprises an outer annular groove on an outer surface thereof; and the protrusions are frictionally engaged within the outer annular groove when the assembly is in the partially engaged position.

6. The assembly of claim 3, wherein:

the tubular wall comprises a radially inwardly extending annular ridge on an inner surface thereof;

the rim comprises an inner annular groove on an outer surface thereof; and the annular ridge is frictionally engaged within the inner annular groove when the assembly is in the fully engaged position.

7. The assembly of claim 3, wherein:

the tubular wall comprises a plurality of radially inwardly extending protrusions on an inner surface thereof;

the rim comprises an outer annular groove on an outer surface thereof;

the protrusions are received within the outer annular groove when the assembly is in the partially engaged position;

the tubular wall comprises a radially inwardly extending annular ridge on an inner surface thereof;

the rim comprises an inner annular groove on an outer surface thereof;

the annular ridge is received within the inner annular groove when the assembly is in the fully engaged position; and the protrusions are located below the annular ridge in an axial direction of the assembly.

8. The assembly of claim 3, wherein the cap further comprises a top wall extending in a radial direction of the cap near a top edge of the tubular wall, wherein the stopper is located below the top wall when the assembly is in the partially engaged position and the fully engaged position.

9. The assembly of claim 8, wherein the top wall defines a central aperture that exposes a top surface of the stopper, wherein the top wall comprises a ring that extends downwardly from a bottom surface thereof, and the ring is received within the aperture when the cap is in the engaged position and the partially engaged position.

10. The assembly of claim 8, wherein the top wall is configured to engage the cover when the cap is in the partially engaged position and the fully engaged position.

11. The assembly of claim 10, wherein the top wall defines a channel and the cover comprises a downwardly extending flange that is received within the channel when the cover is in the partially engaged position and the fully engaged position.

12. The assembly of claim 11, wherein a gap is formed between the flange and the channel, wherein the gap permits gas flow therethrough so as to permit gas flow out from the vial interior when the cap is in the partially engaged position.

13. The assembly of claim 11, wherein the top wall further defines a valley extending from the channel to an outer surface of the tubular wall.

14. The assembly of claim 13, wherein the valley permits gas flow therethrough, so as to permit gas flow out from the vial interior when the cap is in the partially engaged position.

15. The assembly of claim 13, wherein the valley is radially aligned with the hinge that attaches the main body and the cover.

16. The assembly of claim 8, wherein the top wall defines a plurality of openings that permit gas flow therethrough, to permit gas flow out from the vial interior when the cap is in the partially engaged position, wherein the openings form part of a plurality of flow paths through which gas flows out from the vial interior when the cap is in the partially engaged position.

17. The assembly of claim 16, wherein:

the top wall defines a channel;

the cover comprises a downwardly extending flange that is received within the channel when the cover is in the partially engaged position and the fully engaged position; and the openings are formed within the channel.

18. The assembly of claim 8, wherein the top wall further comprises at least one annular projection extending downward from a bottom surface thereof, the at least one annular projection configured to contact the stopper when the cap is in the partially engaged position and the fully engaged position, wherein the at least one annular projection is configured to exert an even force on the stopper when the cap is moved from the partially engaged position to the fully engaged position.

19. The assembly of claim 18, wherein the at least one annular projection comprises two annular projections including a radially inner annular projection and a radially outer annular projection.

20. The assembly of claim 3, wherein the hinge is formed integrally with the main body and the cover.

21. The assembly of claim 20, wherein the cover affixes to the main body when the cap is in the partially engaged position and the fully engaged position, such that the hinge must be broken in order to detach the cover from the main body.

22. The assembly of claim 21, wherein the hinge comprises a perforation to facilitate breaking of the hinge.

23. The assembly of claim 1, wherein the partially engaged position is axially higher with respect to the vial than the fully engaged position.

24. The assembly of claim 1, wherein the vial is formed of glass.

25. The assembly of claim 1, wherein the vial is formed of a polymeric material.

26. The assembly of claim 25, wherein the polymeric material is a cyclic olefin polymer or a cyclic olefin copolymer.

27. The assembly of claim 1, wherein the cap is formed of a polymeric material.

28. The assembly of claim 27, wherein the cap is formed of polypropylene.

29. The assembly of claim 1, wherein the stopper is formed of an elastomeric material.

30. A parenteral vial, stopper and cap assembly, comprising:

a vial having a body defining an interior, and an opening leading to the interior;

a stopper configured to sealingly engage the opening; and a cap configured to cover the opening and the stopper;

wherein the stopper and the cap fit together to form an integral unit;

the cap moves with respect to the vial between a partially engaged position that permits gas flow out from the vial interior, and a fully engaged position in which the stopper sealingly engages the opening;

the cap includes a main body formed as a tubular wall, and a cover that fits over the tubular wall, wherein the vial comprises a neck and a rim at an upper edge of the neck, and the tubular wall surrounds the neck and the rim when the cap is in the partially engaged position and the fully engaged position;

the tubular wall comprises a plurality of radially inwardly extending protrusions on an inner surface thereof;

the rim comprises an outer annular groove on an outer surface thereof;

the protrusions are received within the outer annular groove when the assembly is in the partially engaged position;

the tubular wall comprises a radially inwardly extending annular ridge on an inner surface thereof;

the annular ridge is received within the outer annular groove when the assembly is in the fully engaged position; and the protrusions are located below the annular ridge in an axial direction of the assembly.

31. The assembly of claim 30, wherein the rim defines the opening and wherein the cap is configured to cover the rim when in the partially engaged position and the engaged position.

32. The assembly of claim 30, wherein the cap accommodates and retains the stopper, wherein the stopper comprises a top wall and a plug extending downward from a bottom surface of the top wall, and the top wall sits beneath the cover when the stopper is retained by the cap.

33. The assembly of claim 30, wherein the cap further comprises a top wall extending in a radial direction of the cap near a top edge of the tubular wall, wherein the stopper is located below the top wall when the assembly is in the partially engaged position and the fully engaged position, wherein the top wall defines a central aperture that exposes a top surface of the stopper, wherein the top wall comprises a ring that extends downwardly from a bottom surface thereof, and the ring is received within the aperture when the cap is in the engaged position and the partially engaged position, and wherein the top wall is configured to engage the cover when the cap is in the partially engaged position and the fully engaged position.

34. The assembly of claim 33, wherein the top wall further comprises at least one annular projection extending downward from a bottom surface thereof, the at least one annular projection configured to contact the stopper when the cap is in the partially engaged position and the fully engaged position, wherein the at least one annular projection is configured to exert an even force on the stopper when the cap is moved from the partially engaged position to the fully engaged position, wherein the at least one annular projection comprises two annular projections including a radially inner annular projection and a radially outer annular projection.

35. The assembly of claim 33, wherein the top wall defines a channel and the cover comprises a downwardly extending flange that is received within the channel when the cover is in the partially engaged position and the fully engaged position.

36. The assembly of claim 35, wherein a gap is formed between the flange and the channel, wherein the gap permits gas flow therethrough so as to permit gas flow out from the vial interior when the cap is in the partially engaged position.

37. The assembly of claim 35, wherein the top wall further defines a valley extending from the channel to an outer surface of the tubular wall, wherein the valley permits gas flow therethrough, so as to permit gas flow out from the vial interior when the cap is in the partially engaged position, and wherein the valley is radially aligned with a hinge that attaches the main body and the cover.

38. The assembly of claim 33, wherein the top wall defines a plurality of openings that permit gas flow therethrough, to permit gas flow out from the vial interior when the cap is in the partially engaged position, wherein the openings form part of a plurality of flow paths through which gas flows out from the vial interior when the cap is in the partially engaged position.

39. The assembly of claim 38, wherein:

the top wall defines a channel;

the cover comprises a downwardly extending flange that is received within the channel when the cover is in the partially engaged position and the fully engaged position; and the openings are formed within the channel.

40. The assembly of claim 30, further comprising a hinge that connects the cover to the main body, wherein the hinge is formed integrally with the main body and the cover, wherein the cover affixes to the main body when the cap is in the partially engaged position and the fully engaged position, such that the hinge must be broken in order to detach the cover from the main body, and wherein the hinge comprises a perforation to facilitate breaking of the hinge.

41. The assembly of claim 30, wherein the partially engaged position is axially higher with respect to the vial than the fully engaged position.

42. The assembly of claim 30, wherein the vial is formed of glass, or a polymeric material, such as a cyclic olefin polymer or a cyclic olefin copolymer; and/or the cap is formed of a polymeric material, such as polypropylene; and/or the stopper is formed of an elastomeric material.

* * * * *